US006705129B2

(12) United States Patent
Pot d'Or

(10) Patent No.: US 6,705,129 B2
(45) Date of Patent: Mar. 16, 2004

(54) CIRCULAR KNITTING MACHINE FOR MULTICOLORED PLUSH

(75) Inventor: Mark Pot d'Or, Nettetal (DE)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/239,743

(22) PCT Filed: Mar. 19, 2001

(86) PCT No.: PCT/DE01/01049

§ 371 (c)(1),
(2), (4) Date: Jan. 30, 2003

(87) PCT Pub. No.: WO01/73178

PCT Pub. Date: Oct. 4, 2001

(65) Prior Publication Data

US 2003/0150243 A1 Aug. 14, 2003

(30) Foreign Application Priority Data

Mar. 29, 2000 (DE) ..... 100 15 629

(51) Int. Cl.[7] ..... D04B 27/04
(52) U.S. Cl. ..... 66/93; 66/107
(58) Field of Search ..... 66/8, 19, 91, 92, 66/93, 104, 107, 217, 20, 23, 27, 25

(56) References Cited

U.S. PATENT DOCUMENTS 4,612,784 A * 9/1986 Plath ..... 66/9 R
5,279,133 A * 1/1994 Plath ..... 66/9 R
5,390,511 A 2/1995 Shibata et al. ..... 66/9
5,713,220 A 2/1998 Seino et al. ..... 66/106
5,791,162 A 8/1998 Plath ..... 66/92
5,931,025 A * 8/1999 Lonati et al. ..... 66/217
6,128,930 A * 10/2000 Schmidt ..... 66/92
6,269,665 B1 * 8/2001 Wang ..... 66/91
6,321,575 B1 * 11/2001 Sangiacomo ..... 66/93

FOREIGN PATENT DOCUMENTS

| | | |
|---|---|---|
| DE | 195 05 646 | 8/1996 |
| EP | 0 594 187 | 4/1994 |
| EP | 0 757 124 | 2/1997 |
| JP | 07 042050 | 2/1995 |

OTHER PUBLICATIONS

Form PCT.ISA/210 International Search Report.

* cited by examiner

*Primary Examiner*—Danny Worrell
(74) *Attorney, Agent, or Firm*—Terry T. Moyer; John E. Vick, Jr.

(57) ABSTRACT

The invention relates to a circular knitting machine for multicolored plush. A plush sinker (113) is provided with at least two planes (90, 91) for kinking loop threads of different loop length. The knocking-over sinker (112) has a bill comprising at least two webs (96, 97) for restretching pile loops of different loop length. Plush knitted goods having plush loops of different heights and different colors can be produced by means of said circular knitting machine. Knitted goods being combined of epinglé and velour can thus be produced by shearing the longer plush loops.

4 Claims, 15 Drawing Sheets

III

VII

VII'

VIII

IX

CIRCULAR KNITTING MACHINE FOR MULTICOLORED PLUSH

The present invention relates to a plush-knitting sinker for a circular knitting machine, a holding-down sinker and knock-over sinker for a circular knitting machine, as well as a circular knitting machine in accordance with the introductory clause of claim 3. Moreover, the present invention relates to a knit plush fabric including a base knit fabric formed by a base yarn and piles projecting from the base knit fabric.

Knit fabrics are known to be provided with yarn loops projecting on one or both sides from the base fabric. Such knit fabric is referred to as plush. When the loops projecting from the base fabric are left as closed loops a so-called pile surface, also referred to as "épinglée" surface is created. It is likewise possible to cut of the turns of the loops so that separate yarns are left that project from the base fabric. In such a case, a so-called pile fabric or velour is obtained.

The projection of plush knit fabric may be realized in particular in a circular knitting machine. Circular knitting machines of the known type comprise the following elements:

(a) a row of needles in circular arrangement for forming the stitches and loops, whose rising and lowering movement is controlled by a lifting cam or needle lock along a needle cam;
(b) a holding-down and knock-over sinker (hereinafter briefly referred to as down sinker) as well as a piling sinker, with the down sinker and the piling sinker being disposed in parallel with each other between two respective needles and being able to carry out a reciprocating movement horizontal relative to the needles, which movement is controlled by a sinker lock along a first sinker cam for the holding-down and knock-over sinker and another sinker cam for the piling sinker;
(c) control elements for needle selection in correspondence with the pattern, with the selection of a needle resulting in the fact that the needle follows the needle cam present at its instantaneous location whilst a non-selected needle remains in a home position (circular movement position);
(d) yarn guiding means for feeding a base yarn as well as at least two loop or pile yarns for producing the pile loops.

It is possible in such a circular knitting machine it is possible to predetermine, for a particular stitch of the produced knitting, via the control elements whether a pile loop is to be formed or not with the first and/or the second pile yarn for this stitch. The production of a pile loop takes place only when the needle associated with the particular stitch is selected by the control elements when it passes along the respective stitch at the respective loop yarn. The use of different yarns for the loop yarns permits the production of pile loops of different colors or of different yarn qualities.

The height of the pile loops projecting from the base fabric is controlled by means of the piling sinker in the circular knitting machine, above whose upper edge the loop yarn is retained while the needle draws down a loop out of the yarn (so-called pre-couliering).

Further details of the structure and of the mode of operation of circular knitting machines may be read, for example, in the book "Rundstricken—Theorie und Praxis der Maschentechnik" [*Circular knitting—theory and practice of stitch techniques*] by Iyer, Mammel, Schaech—Bamberg: Meisenbach (1991.

The present invention has been based on the problem of providing a knit plush fabric and a circular knitting machine suitable for producing same, with the knitting being intended to present a novel structure of good visual appearance.

This problem is solved by a piling sinker for a circular knitting machine, which is characterized by the feature that it comprises at least two planes for couliering a pile loop. As has been explained in the foregoing, the height level of the upper edge of a piling sinker determines the length of a pile loop. Conventional piling sinkers are provided with a single upper edge only for couliering the pile loop yarn so that the loop length (also referred to as pile height) is the same for all plush pile loops. In the inventive piling sinker, by contrast, two planes are formed on the piling sinker for couliering a pile loop yarn, which are located at different levels and result accordingly in different pile heights of the pile loop yarns couliered above the respective plane. Which plane is used for couliering a pile loop yarn may be determined by the extent of the radial advance of the piling sinker. The plane used for couliering must be advanced here up to the needle circle.

Due to the use of the inventive piling sinker, it is possible to produce pile loops of different pile heights. The use of the piling sinker in a circular knitting machine suitable to operate with at least two pile loop yarns hence permits the production of pile loops of different heights from respective different yarn materials. The production of such a knit fabric has so far neither been known nor was it possible.

The present invention moreover relates to a holding-down and knock-over sinker (hereinafter briefly referred to as down sinker) for a circular knitting machine, which is characterized by the feature that it comprises at least two planes for tensioning a pile loop yarn. Such a down sinker may be used in a circular knitting machine of the aforementioned type for tensioning pile loop yarns forming pile loops of different pile heights. Tensioning the pile loop yarns of pile lops is known on principle and serves to ensure a strong and even seating of the pile loops in the base fabric. For permitting the tensioning function, the down sinker is provided with a beak that takes up again the pile loops of several courses formed earlier and tensions them slightly so that their anchoring in the base fabric will be improved and their pile height will be evened. The upper edge of the beak constitutes the plane for tensioning of the pile loops so that their height level must correspond to the pile height of the pile loops.

In the known down sinkers, only a single plane is provided at a given level for tensioning the pile loops. In the inventive down sinker, by contrast, at least two planes are provided for tensioning the pile loop yarn so that this down sinker can also be used in the production of a knit fabric with pile loops of different pile heights.

The present invention moreover relates to a circular knitting machine for the production of plush-type knit fabric, which comprises the following elements:

(a) needles for forming stitches and pile loops, whose rising and lowering movement is controlled by a lifting cam lock along a needle cam;
(b) a down and knock-over sinker as well as a piling sinker, which are disposed in parallel with each other and whose reciprocating movement horizontal relative to the needles or the needle movement, respectively, is controlled by a sinker lock along a respective sinker cam for the down sinker or the piling sinker, respectively,
(c) control elements for needle selection in correspondence with the pattern, with a selected needle following the needle cam present at its location, (d) yarn guiding means for feeding a base yarn as well as at least two loop or pile yarns.

The circular knitting machine is characterized by the provision that it comprises a piling sinker of the aforementioned kind. Due to its two planes for couliering a pile loop yarn, such a piling sinker permits the production of a plush-type knit fabric with different loop lengths (pile heights), with the possibility that the pile loops of different lengths may additionally be distinguished from each other by the material of the pile loop yarn (i.e. in terms of yarn quality, color, etc.).

The aforementioned circular knitting machine preferably comprises moreover a down sinker of the above-explained kind, which presents at least two planes for tensioning a pile loop yarn. With such a down sinker it is possible to ensure that the different pile loop systems of different pile heights will all be tensioned individually and that they are hence all fixedly anchored in the base fabric.

Eventually, the invention relates to a plush knit fabric with a base knit fabric formed by a base yarn and with pile loops projecting from the base knit fabric. The plush knit fabric is characterized by the provision that there are at least two groups of pile loops, with the pile loops of one group being distinguished by those of the other group(s) by their pile height and type of yarn. On account of the different pile heights of the pile loops, this plush knit fabric presents an esthetically attractive structure high/low appearance that is additionally enhanced by the fact that the pile loops of different heights are formed of different materials, which may encompass different colors, in particular.

The plush knit fabric is preferably processed by shearing off the higher pile loops so that two terminal yarns are created from each pile loop, which project from the base fabric. As in accordance with the present invention only the higher pile loops are clipped the lower pile loops are left as loops, without being cut open, thus forming a so-called épinglée material. As a whole, the plush knit fabric hence constitutes a mixture of velour and épinglée in its structure, with the two base yarn system materials being possibly distinguished from each other by their kind and by their color in particular.

In the following, the invention will be explained in an exemplary form with reference to the Figures wherein.

Figure 1:
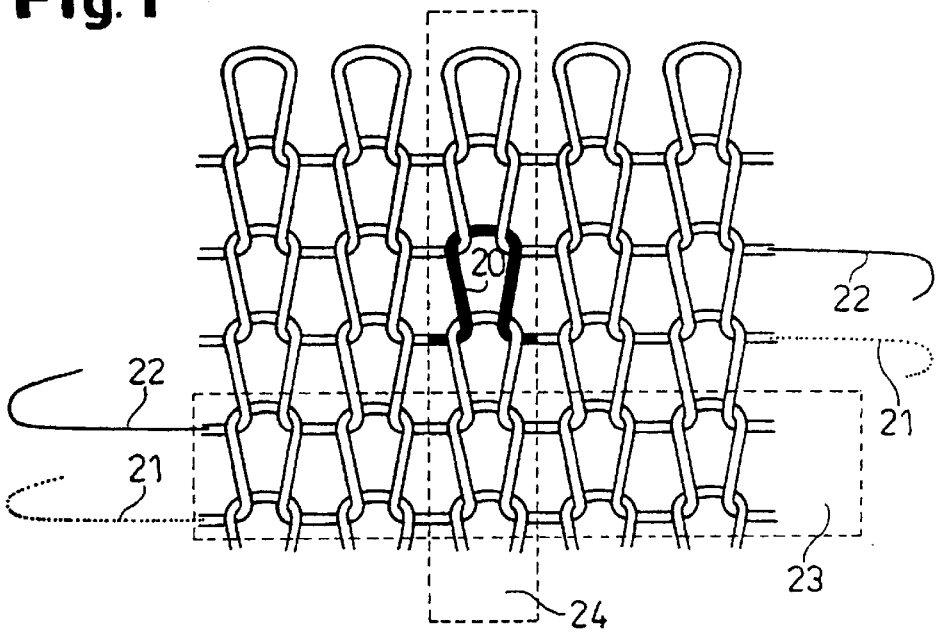
FIG. 1 is a schematic detail from a circularly knit fabric.

For an explanation of the language used here, FIG. 1 is a schematic view of a detail from a circularly knit fabric. In the center of the illustration, an individual stitch 20 is shown as a component of the knitting, which is emphasized in black. The stitch 20 consists of a stitch loop that is held by its two lower ends (the butts or bases) by the head of the stitch of the preceding stitch loop and whose stitch head, in its turn, holds the bases of the following stitch. This creates a dimensionally stable knitting altogether. The knitting is subdivided into stitch courses 23 in the horizontal direction (machine direction of the yarn) and into wales 24 in the vertical direction.

The continuation of the yarns constituting the knitting is roughly indicated for a circularly knit fabric by a dotted line of continuation 21 for a first yarn and a continuous line of continuation 22 for a second yarn. It is apparent from this illustration that the yarns circulate in the manner of spirals. To accelerate the knitting operation and possibly also for the creation of patterns, two or generally even more yarns may constitute spirals extending in parallel with each other and interleaved into each other, as is roughly indicated by the example of two yarns 21, 22 in FIG. 1.

Figure 2:
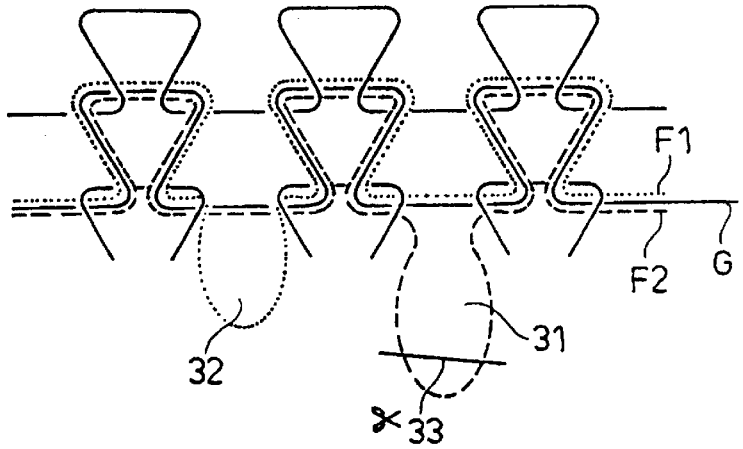
FIG. 2 is a schematic detail from a plush knit fabric with pile loops of different pile heights and in different colors.

FIG. 2 is an enlarged schematic detail from an inventive plush knit fabric. The illustrated lower course of stitches consists here of three yarns principally extending in parallel; in particular, these are the base yarn G, which forms the base knit fabric or base fabric, and two different pile loop yarns F1 and F2 that extend in parallel therewith and may consist, in particular, of different materials of different colors. Seen from the left to the right side, the pile loop yarn F1 (dotted line) follows the base yarn G in the first stitch, and then, however, it forms a loop on the connecting piece between the first stitch and the second stitch (so-called sinker stitch), which must be imagined as projecting from the base fabric upwards and which is referred to as so-called pile loop 32. The formation of such pile loops is known on principle and results in a so-called épinglée structure. In the further course, the first pile loop yarn F1 follows the base yarn G in parallel in the second stitch and in the third stitch.

When seen from the left to the right side, the second pile loop yarn F2 (broken line) extends equally in parallel with the base yarn in the first stitch, but then it remains in parallel with the base yarn G to the second stitch through which it follows the base yarn G in parallel. It forms a pile loop 31 between the second stitch and the third stitch. Subsequently to this pile loop 31, the pile loop yarn F2 follows the base yarn again through the third stitch.

What is important in the knitting according to FIG. 2 is the fact that the first pile loop 32 and the second pile loop 31 present different pile heights (loop lengths) and that they consist additionally of different yarns F1 and F2 that may be different from each other, for instance by their color. This opens designing clearances that permit an esthetically attractive high/low structure of the plush knit fabric with épinglée in different pile heights and of different colors.

It is furthermore possible to process the knit fabric subsequently by shearing and to cut the loops of the longer pile loops 31 open along a parting line 33. As a result, the pile loops 31, which are initially closed, become individual yarns projecting out of the base fabric and forming a so-called velour structure. In the inventive knit fabric, hence an épinglée of a first color can be combined with velour of a second color (or yarn quality).

Figure 3:
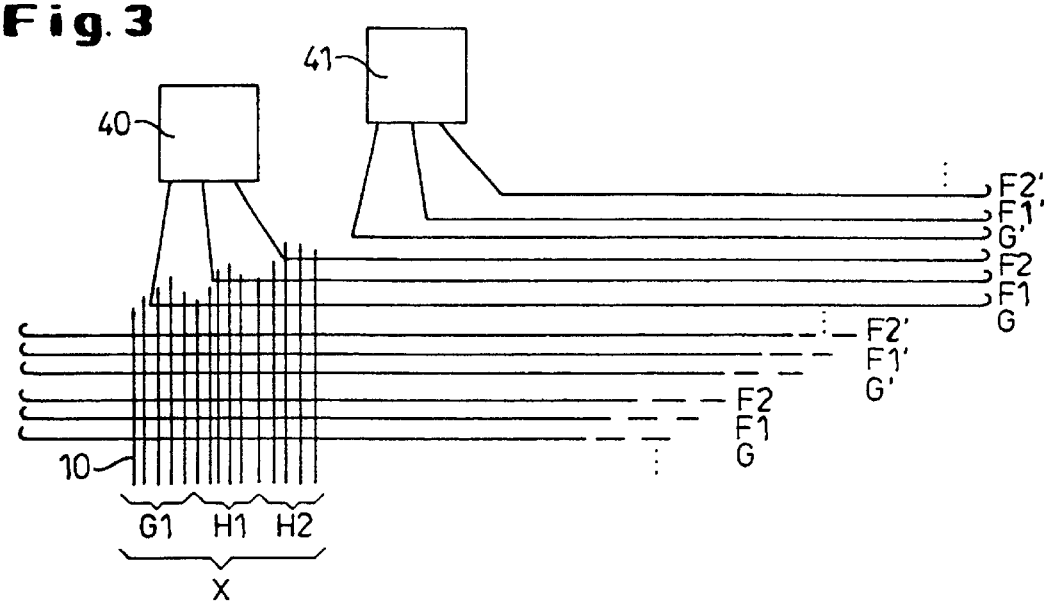
FIG. 3 is a schematic representation of the course of the yarn on a circular knitting machine as well as a system group consisting of a base system and two pile loop systems.

FIG. 3 outlines the mode of operation of a circular knitting machine schematically. What can be seen here is the fundamental course of the base yarn G and of two pile loop yarns F1 and F2 belonging to a first so-called system group X. This means that these three yarns of one course of stitches are processed together, as is illustrated in FIG. 2, for instance.

The yarns G, F1, F2, which come from the right side in FIG. 3, extend in the form of spirals along the hose-type circularly knit fabric altogether. This means that the three yarns at the left end of FIG. 3 retreat into the background and return in spirals to the right edge of FIG. 3 where they arrive at the points correspondingly identified by G, F1 and F2.

The yarns G', F1' and F2' of a second system group follow an analogous course. The two yarn systems G, F1, F1 as well as G', F1' and F2', which extend in parallel and in the form of spirals, hence correspond to the two separate yarns 21 and 22 of FIG. 1. Further yarn systems associated with further system groups are roughly indicted by dots.

Moreover, FIG. 3 shows in a schematic form that the respective yarns G, F1, F2 as well as G', F1' and F2' extend towards yarn feeder means 40 or 41, respectively, where supplies of the respective materials are kept on reels and from where they are supplied to the respective processing location on the circular knitting machine via a yarn guide.

FIG. 3 moreover illustrates a schematic of the needles 10 of a so-called system group X, which extend in parallel and orthogonally on the yarns. The system group X consists of a base system G1 whose needles realize the knitting of the base yarn G, as well as two pile loop systems H1 and H2 that knit the first pile loop yarn F1 or the second pile loop yarn F2, respectively, in the respective course of stitches.

The system group X illustrated in FIG. 3 must be imagined to be continued to the left and the right sides by further system groups disposed along a circular path (so-called needle circle). The adjacent system group on the right side (which is not illustrated) serves to knit the three yarns G', F1' and F2'.

Figure 4:
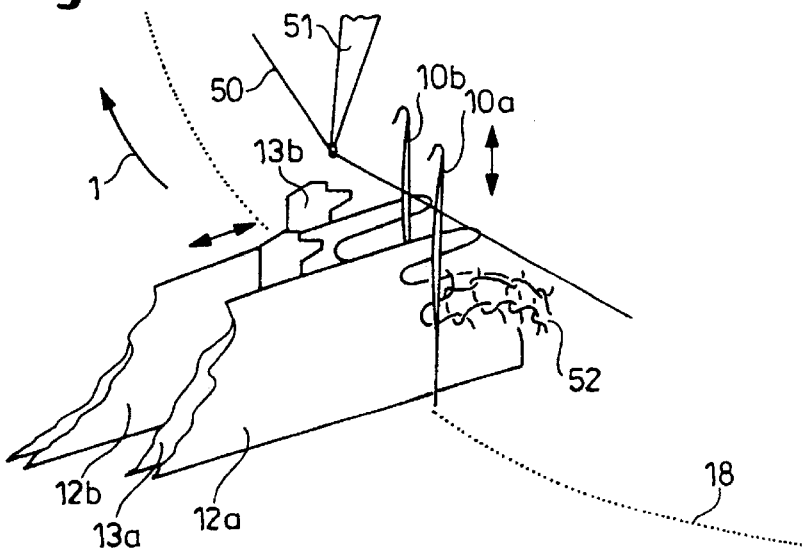
FIG. 4 shows a perspective detail of a circular knitting machine for a clearer explanation of the relative movement of down sinkers and needles.

FIG. 4 is a perspective view of two needles 10*a*, 10*b* as well as of two down sinkers 12*a*, 12*b* and two piling sinkers 13*a*, 13*b*. Such an alternating sequence of needles and sinkers must be imagined to extend all around the needle circle 18 in the circular knitting machine so that each wale is processed by precisely one needle.

The needles 10*a*, 10*b* as well as the sinkers 12*a*, 12*b*, 13*a*, 13*b* together with the knit fabric perform a circulating movement along the needle circle 18, on the one hand, which is roughly indicated by the arrow 1 in FIG. 4. During this circular movement, the needles 10*a*, 10*b* move additionally up and down (double arrow) in order to catch the yarn 50, if applicable, when they pass a stationary yarn guide 51 and in order to coulier above the upper edges of the down sinkers 12*a*, 12*b*, which means that they form a loop of this yarn. This loop may then be drawn particularly through the stitch formed last by the needle 10*a* or 10*b*, respectively, by which action the stitch mentioned last is knocked over and a new stitch is formed from the yarn 50. Such stitch formation from the yarn 50 takes place only when the needle 10*a* or 10*b*, respectively, has been driven out for catching the yarn 50 in correspondence with a pattern-dependent control program. When, by contrast, a needle remains in the so-called circular movement position it does not catch the yarn 50 that extends as floater along the respective wale.

The down sinkers 12*a*, 12*b* and the piling sinkers 13*a*, 13*b* may be reciprocated in a direction orthogonal on the needles 10*a*, 10*b* (double arrow) in order to provide the respective required edge level on the needle circle for support of the yarn 50 or the knit fabric, respectively, in this manner. One respective down sinker and one respective piling sinker are guided in parallel with a sinker passage.

In the following, the concrete realization of a circular knitting machine will be described with reference to FIGS. 5 to 10, which is suitable for the production of the knit fabric illustrated in FIG. 2 in the case of application of a piling sinker 113 according to FIG. 21 and a down sinker 112 according to FIG. 22. The illustration is intended to present a fundamental explanation of the production of a two-colored plush material, which is hence manufactured by means of down sinkers 12 or piling sinkers 13, respectively, in correspondence with prior art.

The machine chosen for the production of the combined épinglée velour knitting is a straight stitch/purl stitch circular knitting machine with an electronically controlled single needle selector. Such a machine serves to produce straight stitch/purl stitch shear plush pile fabrics with jacquard pattern. A special characteristic of these knit fabrics is the particular processing of several pile loop yarns (pile or plush yarns) within a base yarn course. The pile loop yarns are knit by selected needles to form pile loops. When a needle is not selected the pile loop yarn constitutes a floater that is cut off when the knit fabric is finished.

The formation of a stitch and a pile loop in a course of stitches takes place within a system group of the circular knitting machine. One respective base system and one to five pile loop systems constitute a course of stitches. The number of the pile loop systems in a system group is determined by the number of the plush colors to be processed. The pile loops and stitches are formed by a dual sinker technique in which each sinker passage guides one piling sinker and one holding-down and knock-over sinker.

Figure 5:
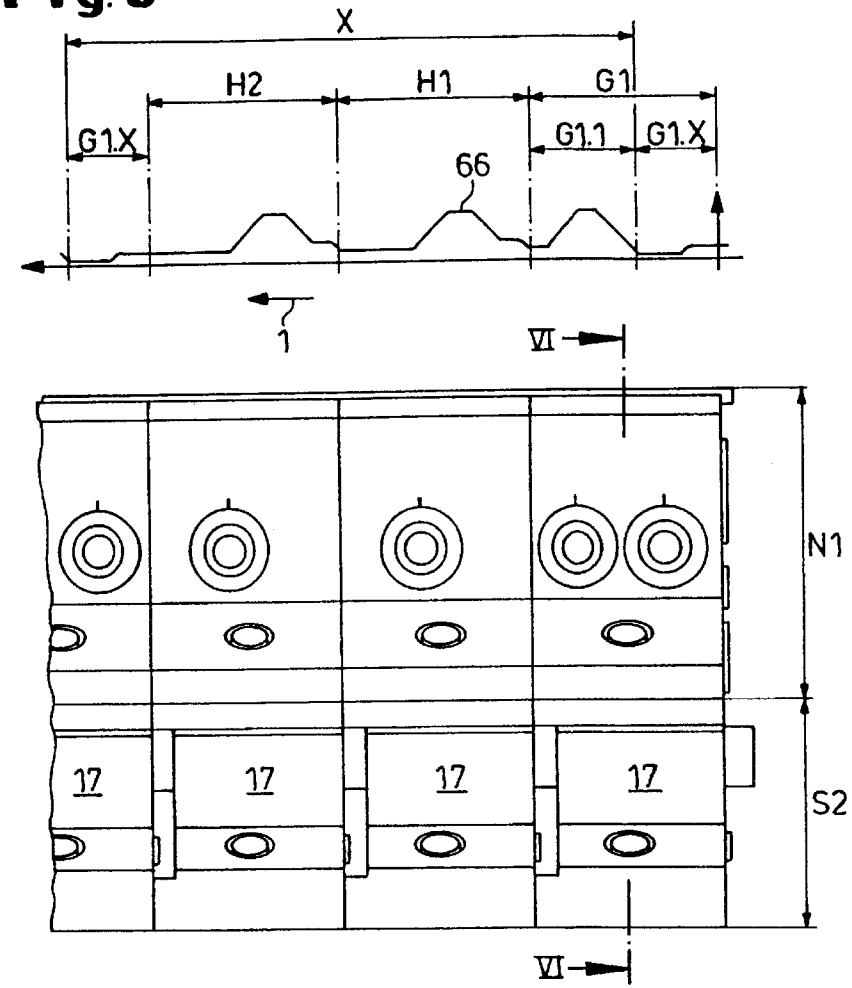
FIG. 5 is a side view of the lifting cams of a system group as well as the associated needle cam.

The lower part of FIG. 5 illustrates a side view on the operator side of the so-called cylinder cam of the circular kitting machine. The cylinder cam surrounds the circular knitting machine once along a circular path and is subdivided into individual segments 17. The segments contain so-called cam passages on their inner side (which is not visible in FIG. 5), in which a needle 10 with a corresponding base is guided in order to follow the vertical course of the cam passage, which creates the desired up and down movement of the needle 10.

Figure 6:
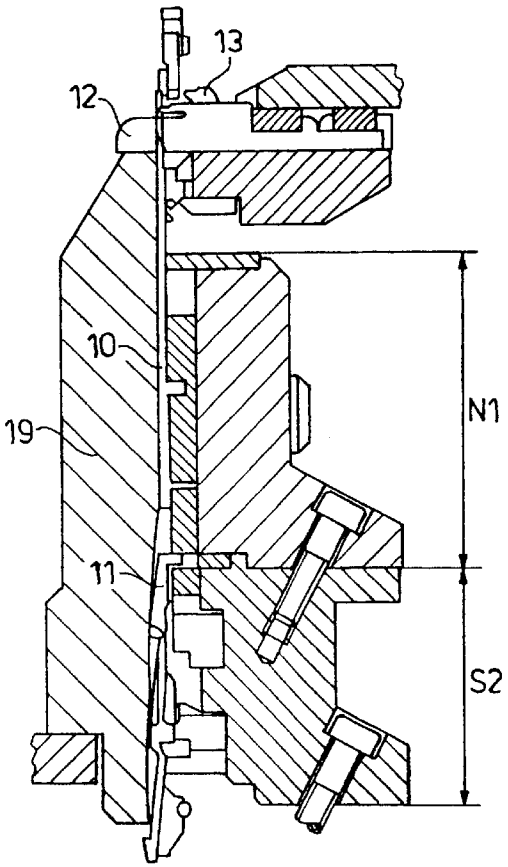
FIG. 6 shows a sectional view taken through the lifting cam along the line A—A in FIG. 5.

The needle guiding action is understood better from FIG. 6 that shows a cross-sectional view taken along the line VI—VI in FIG. 5. There, a needle 10 can be seen that is supported in a vertical passage in the cylinder 19. The cylinder 19 rotates as the circular knitting machine operates, carrying along the needle 10 as well as the knit fabric suspended therefrom. The cylinder cam is disposed in a stationary arrangement relative to the rotating cylinder 19, and consists of the lifting cam N1 and the control sinker cam S2. In the aforementioned cam passage on the inner side of the lifting cam N1 engages the needle 10 by hooking one base thereof and is hence moved up and down in correspondence with the vertical extension of the cam passage when a relative movement is brought about between the cylinder 19 and the cylinder cam.

Figure 7:
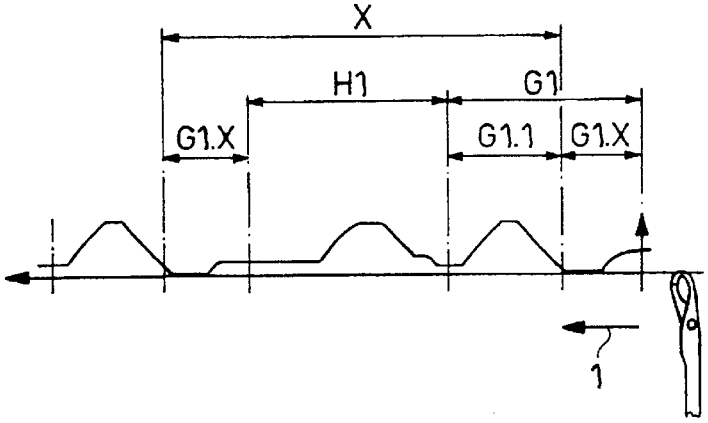
FIG. 7 illustrates a system group including a base yarn and one pile loop yarn.
Figure 8:
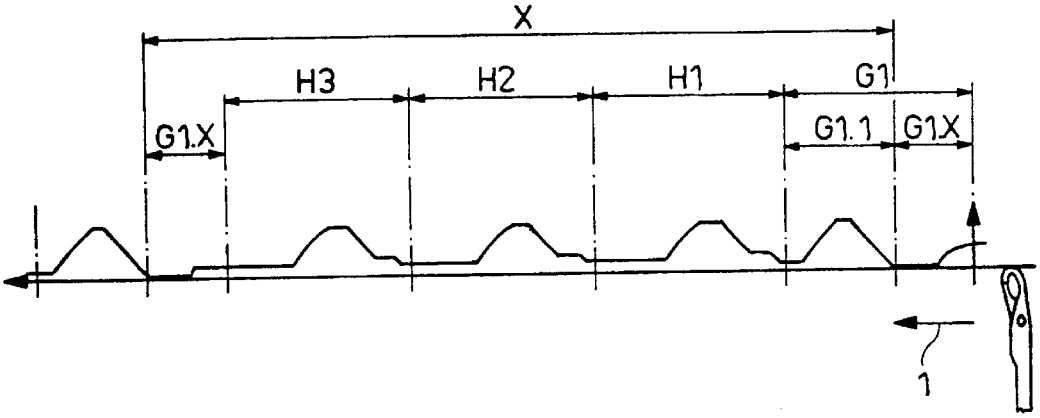
FIG. 8 shows a system group including a base yarn and three pile loop yarns.

The up and down movement of the needle 10, which is achieved in this manner, is illustrated in FIG. 5 above the cylinder cam by the so-called cylinder needle cam or briefly needle cam 66. It is obvious from this illustration that the cylinder cam can be combined in functionally independent system groups X in the peripheral direction of the circular knitting machine. Each system group X begins with a base system G1 that is joined by one, two, three or more pile loop systems H1, H2, H3, depending on the number of colors of the pile loops. A system group with two pile loop systems is illustrated in FIG. 5 whereas a system group X with a single pile loop system H1 is shown in FIG. 7 and a system group X with three pile loop systems H1, H2, H3 is illustrated in FIG. 8. In correspondence therewith, a single-color plus fabric can be produced with the cylinder needle cam according to FIG. 7 whilst the cylinder needle cam of FIG. 5 serves to produce a two-colored plus and the cylinder needle cam of FIG. 8 is used to produce a three-colored plus fabric.

The base system G1 is associated with the processing (knitting) of a base yarn G. In the pile loop system H1, a first pile loop yarn F1 of a first color is processed whilst, in correspondence, in the second and possibly in the third pile loop system H2 or H3, respectively, a second or third pile loop yarn is processed, which has a second or third color. The base system and the pile loop systems in each system group cooperate with each other to constitute a course of plush loop stitches, with each stitch of the course preferably including a pile loop (cf. FIG. 2).

The needles 10 as well as the down sinkers 12 and piling sinkers 13 move through the cylinder cam illustrated in FIG. 5, from the right to the left side in the direction of the arrow 1. The cylinder cam shown in FIGS. 5 and 6 performs two supplementary functions with respect to the needles 10, specifically:

(a) controlling and guiding the needles 10, and
(b) selecting, controlling and guiding the control sinkers 11.

The function (a) is carried out in the upper cam region, in the lifting cam N1, whereas the partial function (b) is carried out in the lower cam region, i. e. the control sinker cam S2. In detail, the lifting cam N1 and the control sinker cam S2 in the systems G1, H1 and H2 perform the following functions:

Base system G1, region of the control sinker cam S2:
Cam region for guiding the control sinkers 11 in a circular movement. The control sinkers pass through the cam in the circular movement position and are prepared for the pattern selection on the following pile loop system H1.

Base system G1, region of the lifting cam N1:
Seen along the direction of operation of the machine, the base system G1 presents initially a stitch-knitting region G1.X in the lifting cam N1 and a joining needle drive-out and needle retraction region G1.1. Both regions G1.X and G1.1 are combined in a base system G1.

Stitch knitting region G1.X:
The stitch-knitting region G1.X is the terminal region of each system group X. In this region, the stitches and pile loops of a course of stitches, which have been prepared in the preceding system group X, are completely formed and knocked over in this region.

Needle drive-out and needle retraction region G1.1:
The needle drive-out and needle retraction region G1.1 is the beginning of a system group X. All the needles are lifted into the knitting position and seize the base yarn during their draw-in movement. The stitches of the base yarn course are prepared by pre-couliering the base yarn to form loops. The needles are merely drawn off the needle up to tucking. The old stitch is not knocked over, it remains on the closed tongue of the needle.

Pile loop system H1, region of the control sinker cam S2:
Cam region for selecting, guiding and controlling the control sinkers 11 into the circular movement or knitting position. The control sinkers lift the associated needles 10 into the knitting position or leave them in the circular movement position.

Pile loop system H1, region of the lifting cam N1:
The cam region for lifting and controlling the needles 10 into the circular movement or knitting position. Needles lifted into the knitting position seize the pile loop yarn of color 1, form a pile loop and are then drawn off up to tucking on the needle. Needles guided in a circular movement form a floater with color 1.

Figure 9:
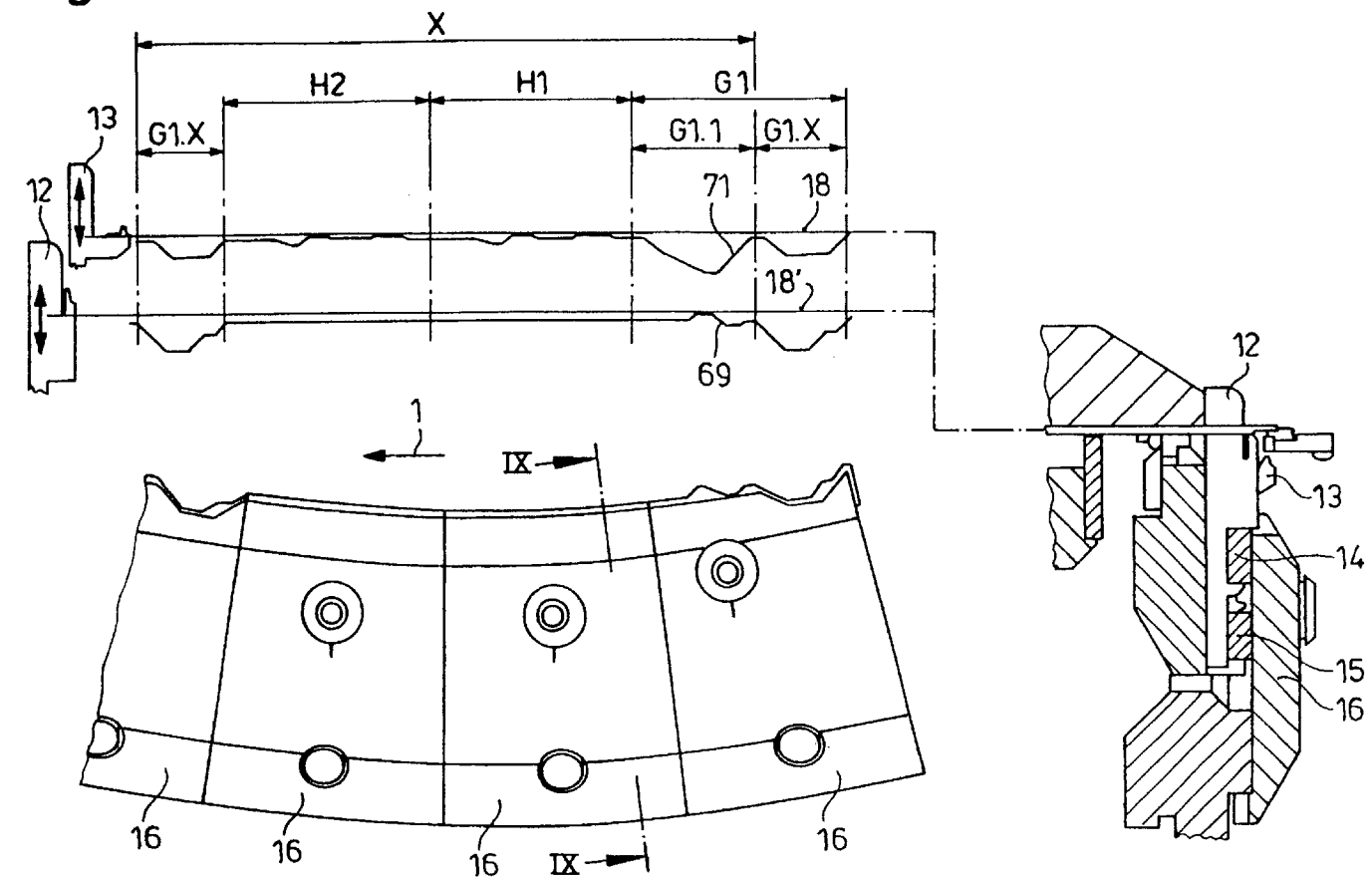
FIG. 9 is a plan view of the sinker cams of a system group as well as the associated sinker cams for the down sinker and the piling sinker, as well as furthermore a sectional view taken through a sinker cam along the line IX—IX.

The lower left part of FIG. 9 shows the plan view of the operator side of a sinker cam for the system group X from FIG. 5. The sinker cam is subdivided into individual segments 16 that present grooves on their inner side (not illustrated), which present the extension illustrated in the upper part of FIG. 9 in correspondence with the sinker curves 69, 71.

As can be seen in the right part of the cross-sectional view of FIG. 9, taken along the line IX—IX, the down sinker 12 and the piling sinker 13 are guided by corresponding projections in the grooves or cam curves 14 for the down sinker or 15 for the piling sinker, respectively. As a result, they carry out a movement orthogonal on the needle or on the needle circle 18, 18', respectively. This movement, which is radial (relative to the rotating cylinder), of the sinkers 12, 13 is carried out when the sinkers disposed in a side-by-side relationship move in the direction of arrow 1 through the segments 16 of the sinker cam.

The system groups X on the sinker cam and on the cylinder cam must always present the same system division in mutual opposition so that needles and sinkers may cooperate in synchrony in the desired manner. FIG. 9 hence continues the example of FIG. 5 in which a two-colored plush is produced from a base system G1 and two pile loop systems H1, H2.

The function of the sinker cams relative to the system group X is as follows:

Base system G1:
Plush and down sinkers are retracted from the needle circle during the complete formation of the loops and pile loops (terminal region G1.X). In the needle draw-in region (starting region G1.1) both sinkers are advanced towards the needle circle for preparing the course of base stitches.

Pile loop systems H1, H2, H3:
The down sinkers pass through these systems in a slightly retracted position and remain without function. The piling sinkers are positioned in an advanced position relative to the needle circle, forming the pile loops. The functions of the pile loop systems H1, H2, H3 are identical.

Figure 10:
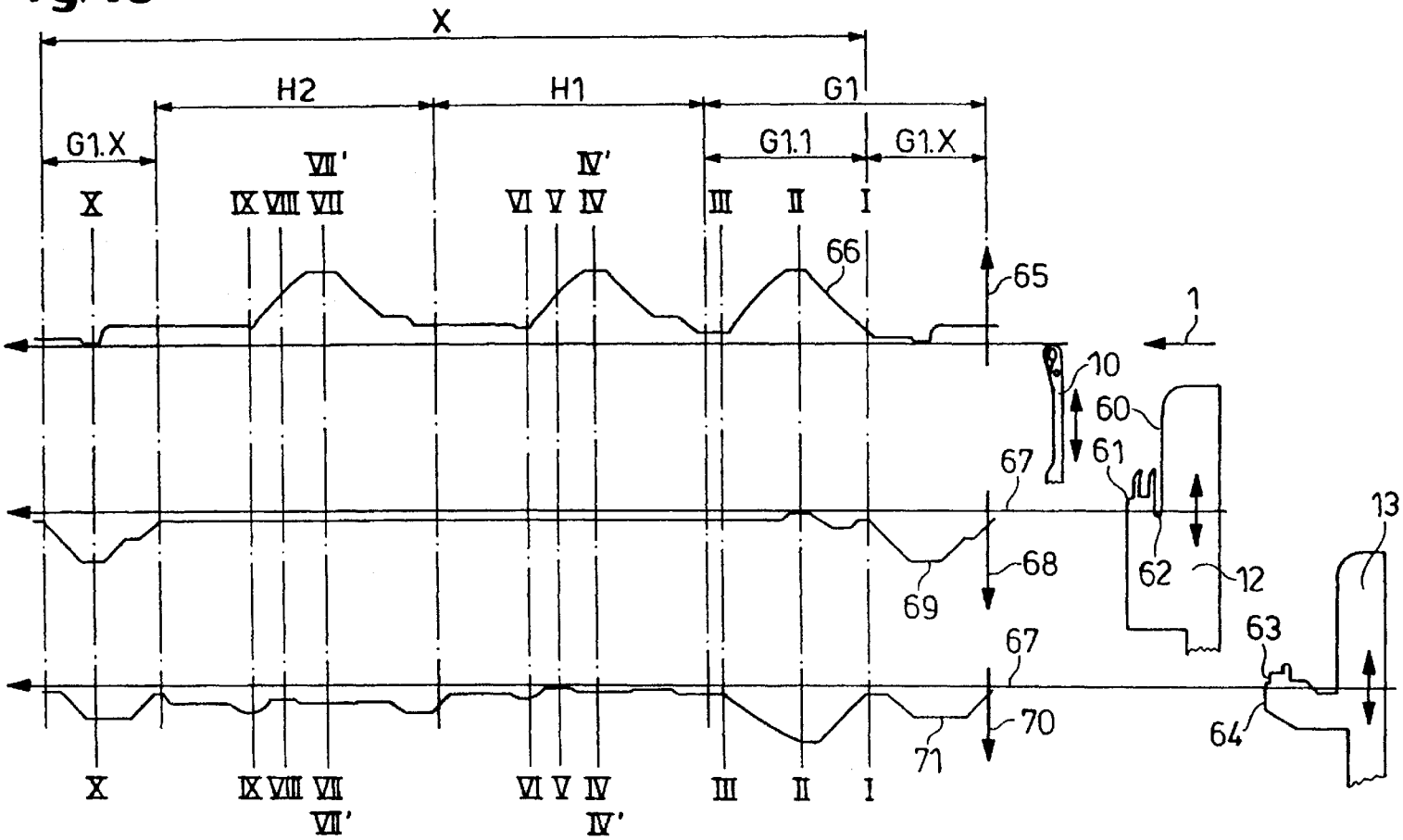
FIG. 10 is a parallel view of the needle cam as well as the sinker cams of the down sinker and the piling sinker for a system group X.

FIG. 10 illustrates the needle curve, the sinker cam 69 of the down sinker 12 as well as the sinker cam 71 of the piling sinker 13 in parallel for the system group X. The cooperation of the element, which will be explained below, will become apparent from this constellation.

The stitch and loop formation in a course of stitches takes place within the system group X that consists of a base system G1 and two pile loop systems H1, H2. The various needle positions I to X relate to the FIGS. 11 to 20 and correspond to the process of stitch and pile loop formation on the individual systems.

What can be seen here is the needle curve 66 that is defined by the head of the needle 10 in the direction of movement 65 relative to the lower stitch knock-over edge 60 of the down sinker 12. The curve 69 of the down sinker 12 (enclosing groove) is illustrated underneath. The arrow 68 identifies the direction of movement of the down sinkers relative to the needle circle 67. The lowermost diagram shows the curve 70 of the piling sinker (orthogonal presser edge). The arrow 70 identifies here the direction of movement of the piling sinker relative to the needle circle 67.

Moreover, the upper knock-over edge 61 and the enclosing groove 62 of the down sinker, the upper knock-over edge 64 and the lower knock-over edge 63 of the piling sinker 13 as well as the direction of movement 1 of the needles and sinkers in the peripheral direction are illustrated here.

The needle and sinker functions in the process of stitch and pile loop formation on the various systems are as follows:

Base system G1, starting region G1.1:

All needles are driven out into the knitting position, take up the base yarn and are drawn in up to tucking on the needle (needle positions I to III).

Pile loop system H1:

Needles for color 1 are driven out into the knitting position in correspondence with the pattern, take up the pile loop yarn (color 1) and are drawn in up to tucking on the needle. Needles guided in a circular movement constitute a floater (needle positions IV to VI).

Pile loop system H2:

Needles for color 2 are driven out into the knitting position in correspondence with the pattern, take up the pile loop yarn (color 2) and are drawn in up to tucking on the needle. Needles guided in a circular movement constitute a floater (needle positions VII to IX).

Base system G1, knitting region G1.X:

All needles are drawn into the stitch knock-over position for final couliering. Couliering of all stitches in one course of stitches are completed (needle position X).

The individual phases in the production of two-colored plush are illustrated in FIGS. 11 to 20. Here, an inventive down sinker 112 as well as an inventive piling sinker 113 are used.

Figure 21:
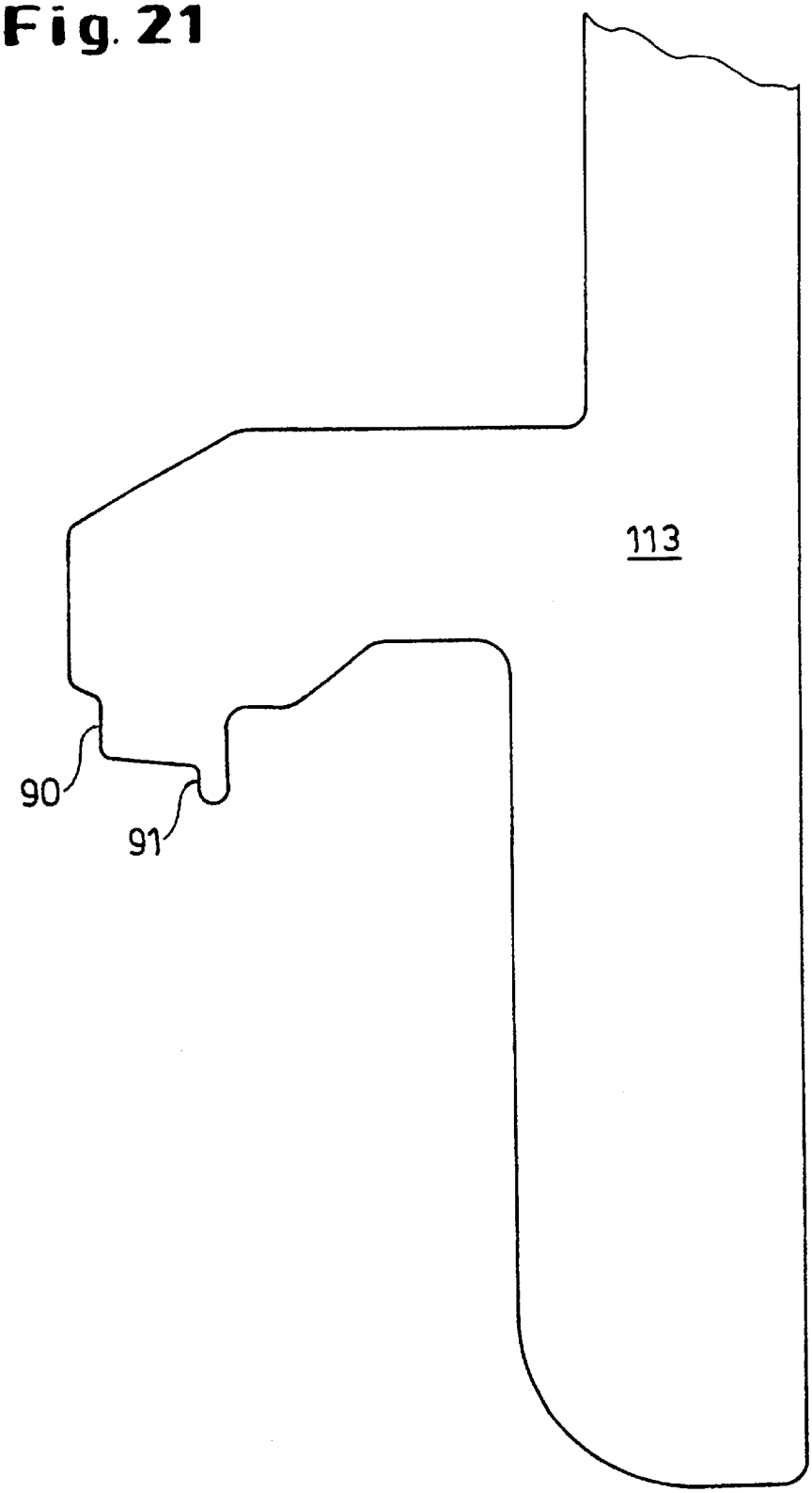
FIG. 21 shows an inventive piling sinker.

The functional range of the piling sinker 113 is shown in more details in FIG. 21. What can be seen here are the two parallel planes 90, 91 presented by the piling sinker 113 on its upper side so as to enable the couliering of a pile loop yarn. Which of the planes 90, 91 is respectively used for couliering can be controlled by the radial advance of the piling sinker 113.

Figure 22:
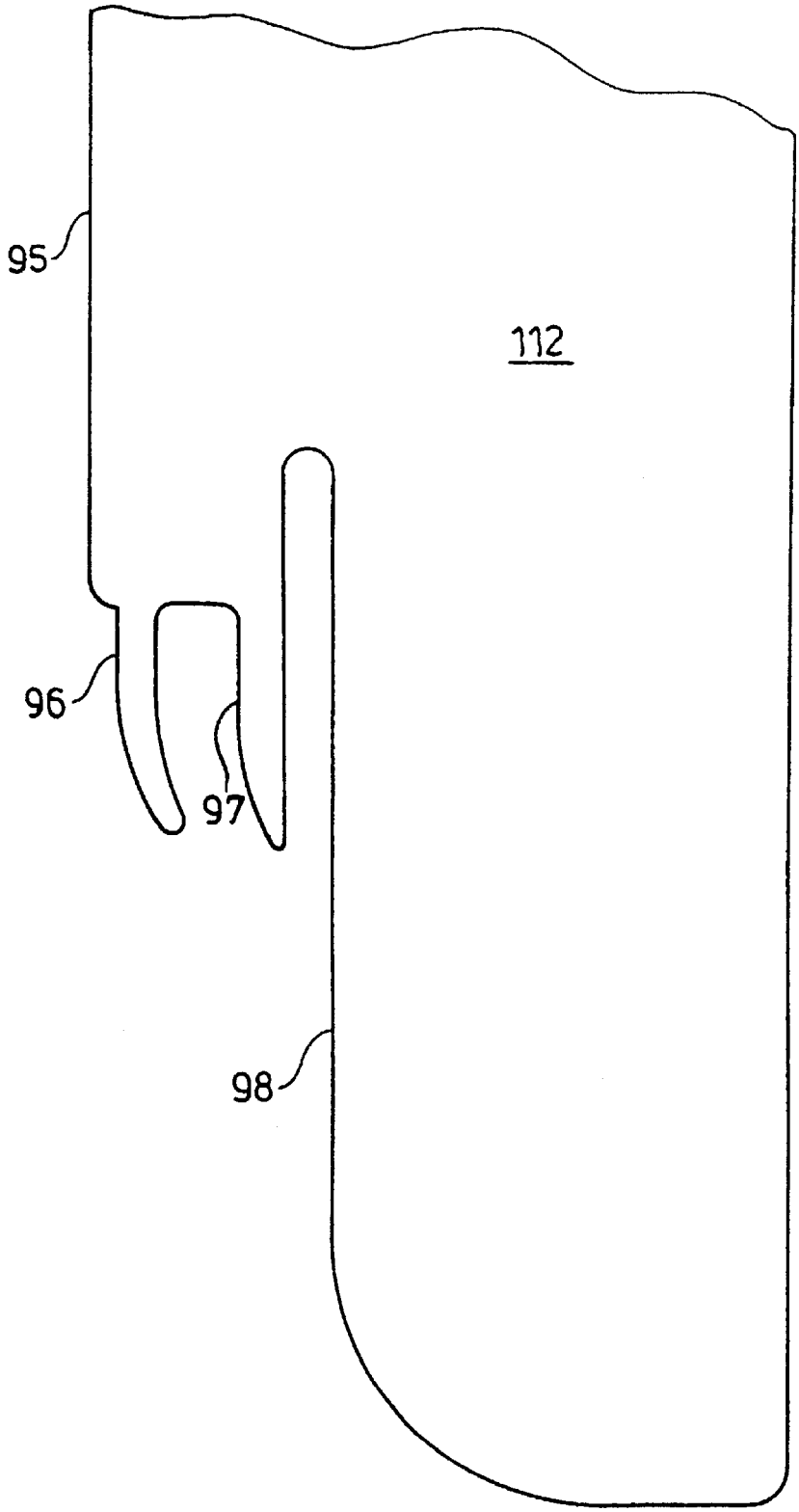
FIG. 22 is a view of an inventive down and knock-over sinker.

According to FIG. 22, the down and knock-over sinker 112—like the known holding-down sinkers—comprises a knock-over edge 98 via which the finished stitch is knocked over, as well as an upper edge 95 via which the base yarn is couliered. In distinction from conventional down sinkers for the production of a plush fabric, the inventive down sinker 112, however, comprises a bipartite nose with the parallel crossbars 96 and 97. These crossbars serve to tension pile loops of preceding stitches. As pile loops of different pile heights are knitted in accordance with the invention the tensioning action is performed via the edge 96 or 97 that matches the respective pile height.

The production of a plush-type knit fabric with more than two pile loops is also possible, of course, in which case the piling sinker ought to present a corresponding number of couliering planes whilst the down sinker ought to present a corresponding number of crossbars for tensioning.

Figure 11:
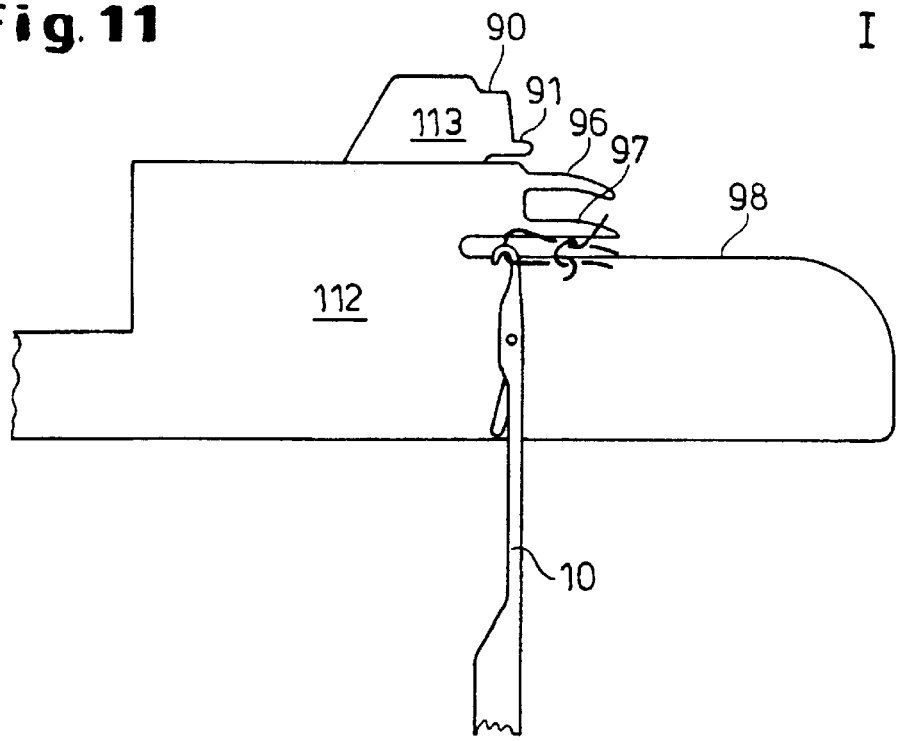
FIGS. 11 to 20 illustrate the cooperation of needles and the down sinker as well as the piling sinker in realizing a system group.

In accordance with FIGS. 11 to 20, the process in an inventive circular knitting machine proceeds through a system group X in the following steps:

Needle position I, FIG. 11 (base system G1, starting region G1.1, base yarn):

Home position of needle 10, down sinker 112 and piling sinker 113.

The needle is positioned for a circular movement. The needle head is flush with the lower stitch knock-over edge 98 of the down sinker 112. The dual-yarn stitch formed last, which consists of the base and the pile loop yarns, is suspended in the needle head. The piling sinker is advanced to the needle.

Figure 12:
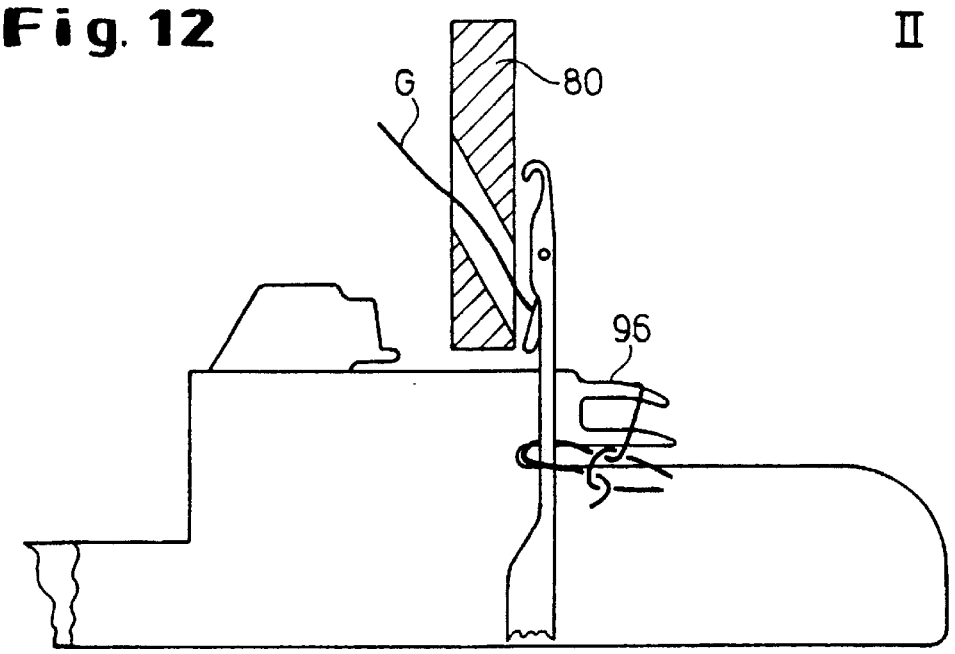

Needle position II, FIG. 12 (base system G1, central region G1.1, base yarn):

Yarn feeding position for the base yarn G.

The needle has been raised into the knitting position. It takes up the base yarn G from the yarn feeder 80 by means of the opened needle head. The stitch formed last has been slipped over the opened needle tongue onto the needle shaft. The down sinker has been advanced to the front towards the needle and tensions the previously formed pile loop over the upper crossbar 96. This tensioning action can be adjusted. The down sinker is in the clearing or holding-down position. The stitch formed last is held in the enclosing groove. The piling sinker is in the retracted position opposite the needle. It is without function.

Figure 13:
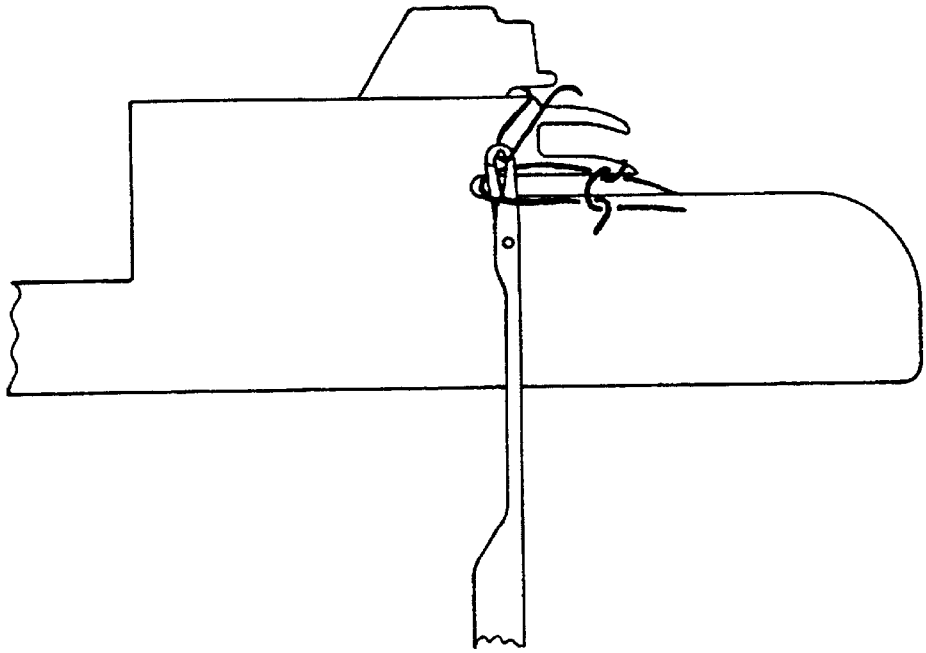

Needle position III, FIG. 13 (base system G1, terminal region G1.1, base yarn):

Couliering position for the base yarn.

The needle has been drawn in into the couliering position (tucking on the needle). The base yarn has been couliered over the upper knock-over edge of the down sinker to form a loop. The size of the loop can be adjusted.

The stitched formed last is not knocked over. It remains on the closed needle head. The pre-couliered base yarn loop is held between the needle head and the upper knock-over edge of the down sinker. The stitch formed last is held in the enclosing groove. The piling sinker has been advanced to the front towards the needle.

Figure 14A:
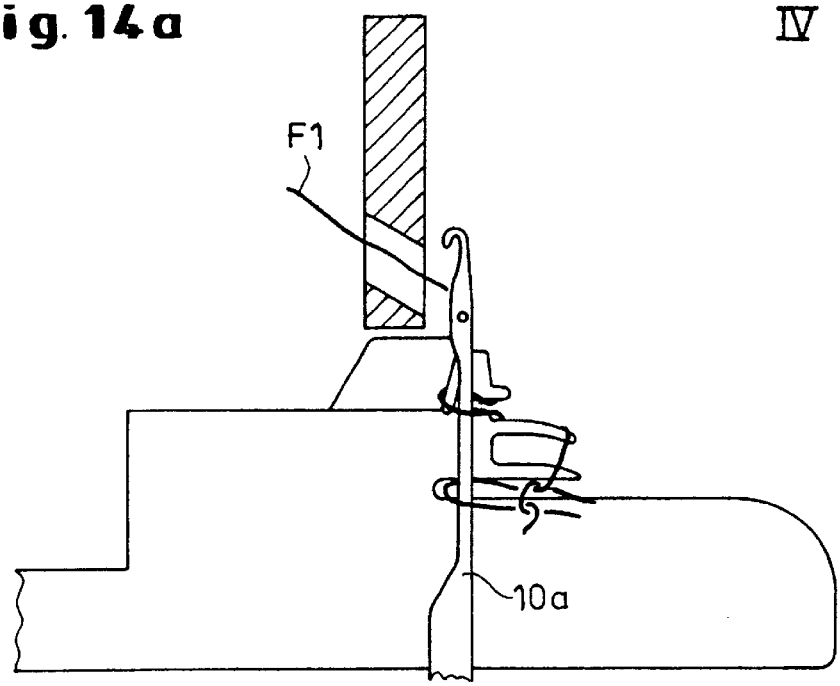

Needle position IV, FIG. 14*a* (pile loop system H1, pile loop yarn F1):

Yarn feeding position for the pile loop yarn F1, color 1:

A needle 10*a* selected for color 1 has been raised into the knitting position. It takes up the pile loop yarn F1 (color 1) by means of the opened needle head. The pre-couliered base yarn loop is held in tensioned condition around the needle by the orthogonal presser edge of the piling sinker. This tensioning action can be adjusted over the entire system width H1. The stitch formed last is held in the enclosing groove.

Figure 14B:
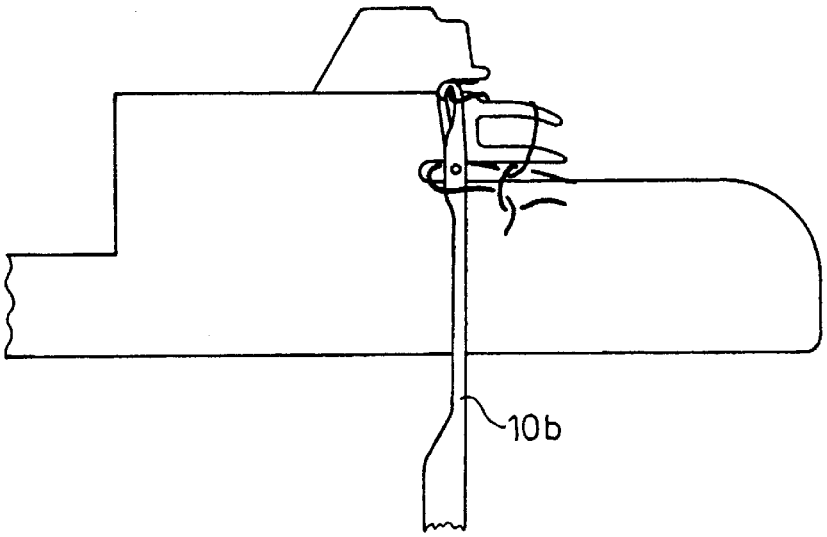

Needle position IV', FIG. 14*b* (pile loop system H1, pile loop yarn F1):

Circular movement of a non-selected needle 10*b*.

The needle has not been selected from color 1. It passes through the system H1 in the circular movement position. The pile loop yarn F1 (color 1) forms a floater. The pre-couliered base yarn loop is held in tensioned condition around the needle by the vertical presser edge of the piling sinker. This tensioning action can be adjusted over the entire system width H1. The stitched formed last is held in the enclosing groove).

Figure 15:
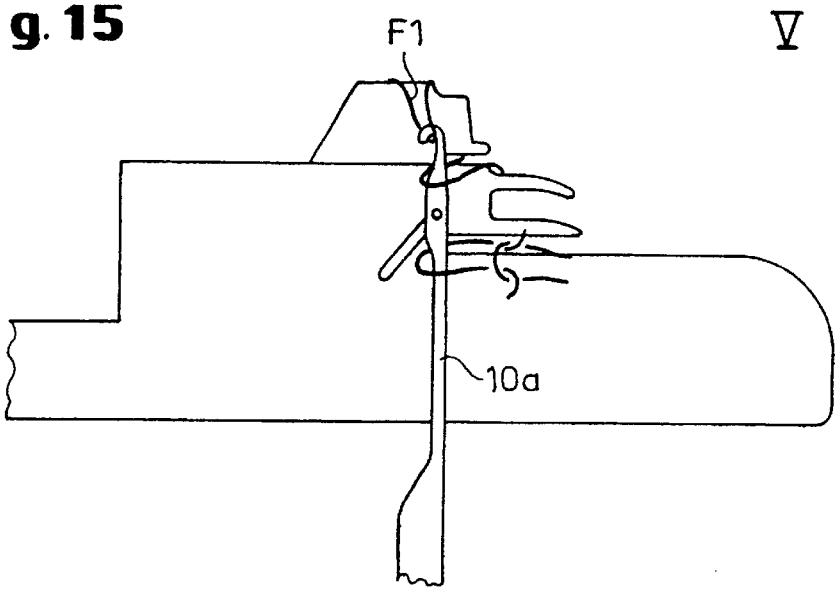

Needle position V, FIG. 15 (pile loop system H1, pile loop yarn F1):

Loop formation with the pile loop yarn F1 (color 1).

The needle 10*a* (selected in correspondence with needle position IV) is guided downwards and draws a pile loop over the upper knock-over edge of the piling sinker.

Needles 10*b* guided in a circular movement, by contrast, form a floater.

The pre-couliered base yarn loop is held in tensioned condition around the needle by the vertical presser edge of the piling sinker. The stitch formed last is held in the enclosing groove).

Figure 16:
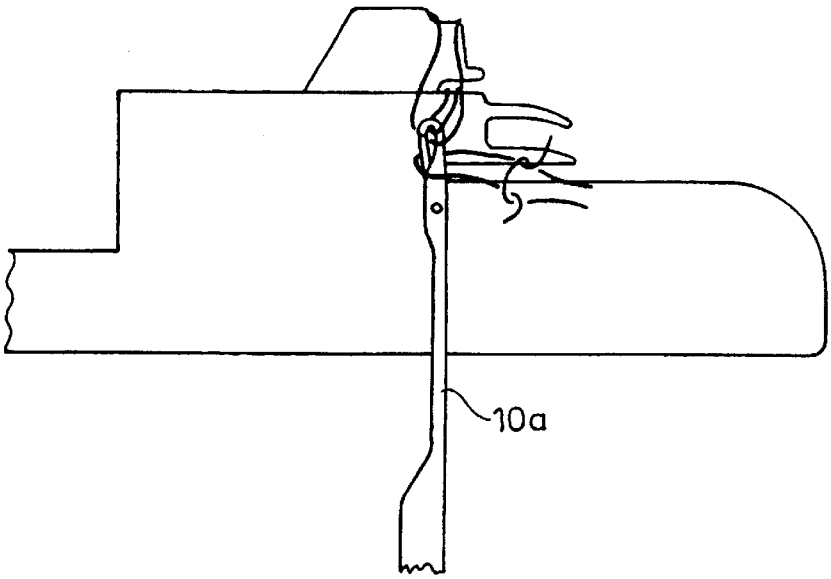

Needle position VI, FIG. 16 (pile loop system H1, pile loop yarn F1):

Couliering position for the pile loop yarn F1 (color 1).

The piling sinker has been retracted from the needle 10*a*. In the couliering position, the needle is drawn in (tucking on the needle). The pile loop yarn F1 (color 1) is couliered over the middle knock-over edge 90 of the piling sinker to form a pile loop. The size of the loop can be adjusted. The base yarn and the pile loop yarn F1 (color 1) are enclosed in the needle head. Both yarns form loops. The stitch formed last is not knocked over. It is enclosed in the enclosing groove and remains on the closed needle head.

Figure 17A:
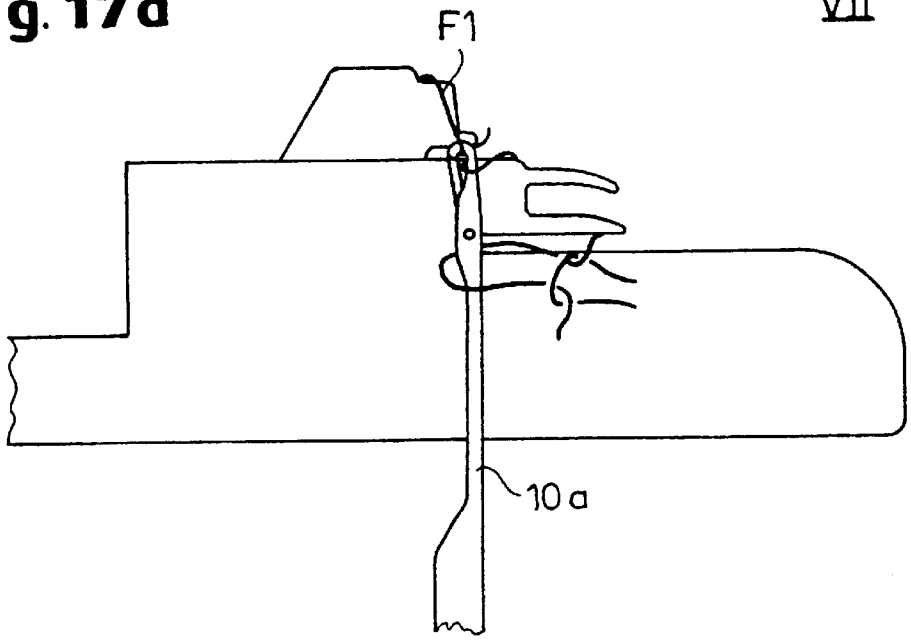

Needle position VII, FIG. 17*a* (pile loop system H2, pile loop yarn F2):

Circular movement of a non-selected needle 10*a*.

The needle has not been selected for color 2. It passes through the system H2 in the circular movement position. The pile loop yarn F2 (color 2) constitutes a floater. The pre-couliered base yarn loop is held in tensioned condition around the needle by the vertical presser edge of the piling sinker. This tensioning action can be adjusted over the entire system width H2. The stitch formed last is held in the enclosing groove.

Figure 17B:
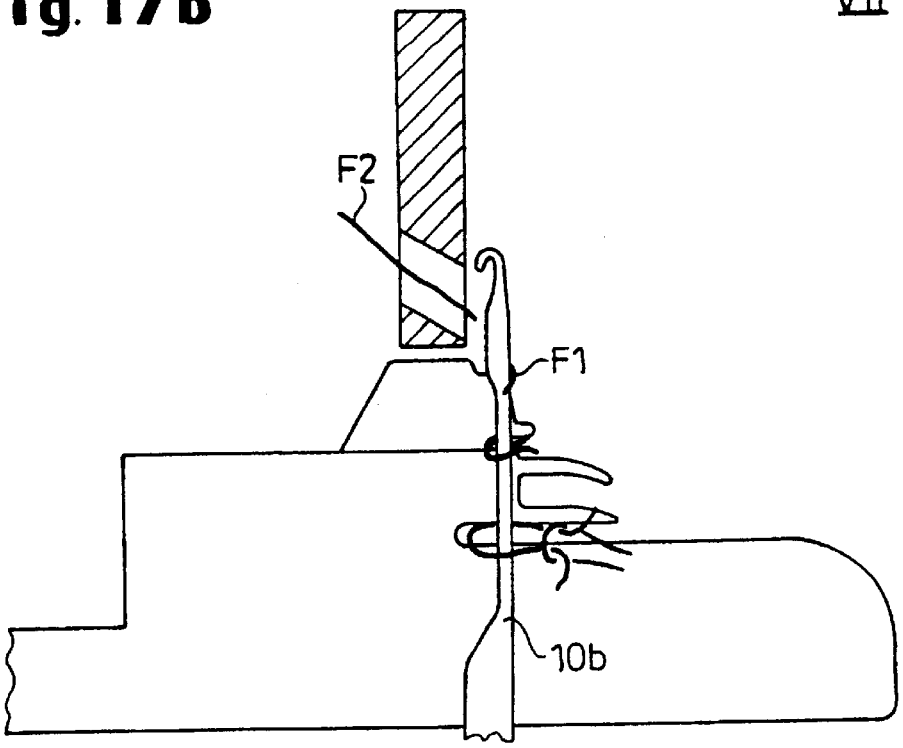

Needle position VII', FIG. 17*b* (pile loop system H2, pile loop yarn F2):

Yarn feeding position for the pile loop yarn F2 (color 2).

A needle lob selected for color 2 has been raised into the knitting position. It takes up the pile loop yarn F2 by the opened needle head (color 2). The pre-couliered base yarn loop is held in a tensioned condition around the needle by the vertical presser edge of the piling sinker. The stitch formed last is held in the enclosing groove. The floating pile loop yarn F1 of color 1 is urged towards the inside onto the needle back by the upper step of the piling sinker when the needle is driven out.

Figure 18:
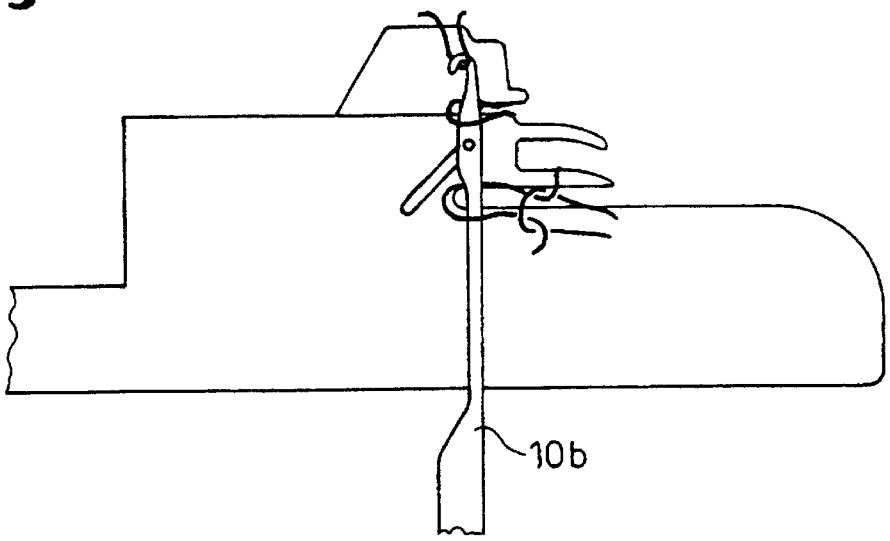

Needle position VIII, FIG. 18 (pile loop system H2, pile loop yarn F2):

Loop formation with the pile loop yarn F2 (color 2).

The selected needle 10*b* (according to the needle position VII) is passed downwards and draws a pile loop over the upper knock-over edge of the piling sinker. The pre-couliered base yarn loop is held in tensioned condition around the needle by the vertical presser edge of the piling sinker. The stitch formed last is held in the enclosing groove.

Figure 19:
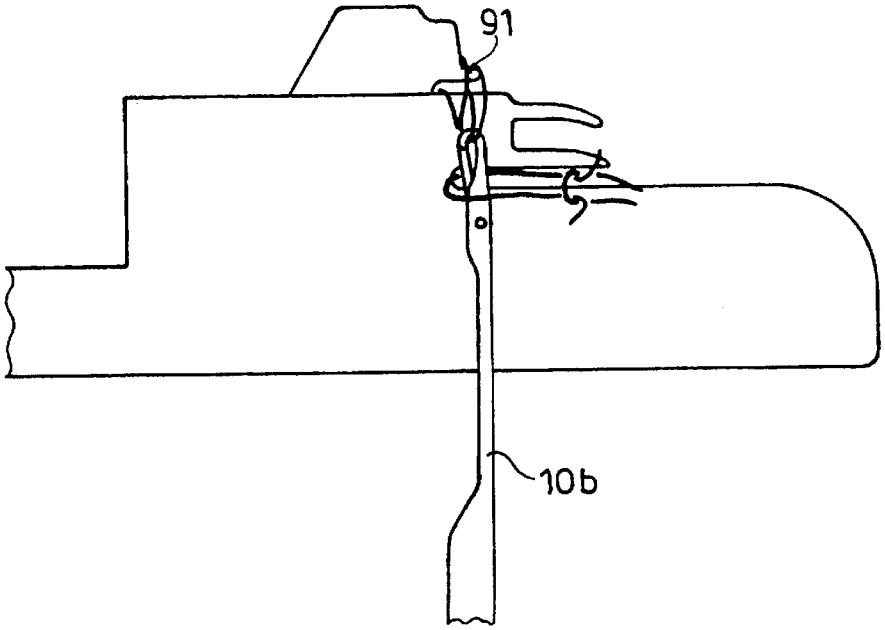

Needle position IX, FIG. 19 (pile loop system H2, pile loop yarn F2):

Couliering position for the pile loop yarn F2 (color 2).

The piling sinker has been retracted from the needle 10*b*. In the couliering position, the needle is drawn in (tucking on the needle). The pile loop yarn F2 (color 2) is couliered over the lower knock-over edge 91 of the piling sinker to form a pile loop. The loop size is adjustable. The base yarn and the pile loop yarn F2 (color 2) are enclosed in the needle head. Both yarns form loops. The stitch formed last is not knocked over. It is enclosed in the enclosing groove and remains on the needle head.

Figure 20:
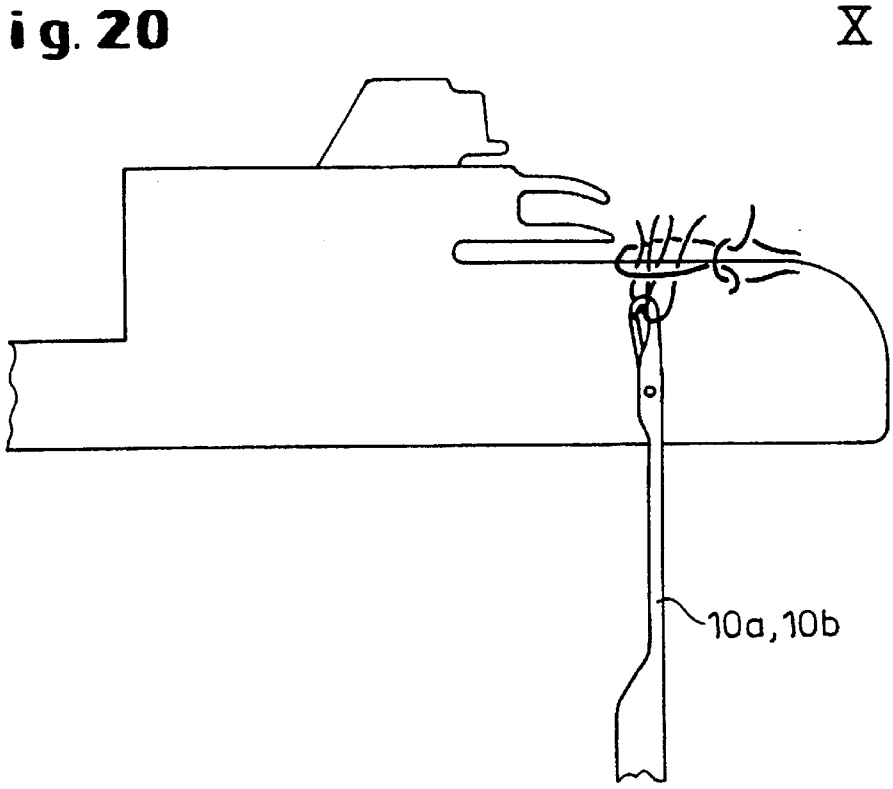

Needle position X, FIG. 20 (base system G1, knitting region G1.X):

Final couliering and stitch knock-over position.

The down sinker and the piling sinker are retracted from the needles 10*a*, 10*b* and release the loop of the pile loop yarn and the loop of the base yarn. The loops of the base yarn G and the pile loop yarn F1 or F2 (colors 1 or 2) are drawn through the stitch formed last and knocked over via the lower knock-over edge of the down sinker.

With the beginning of the following system group, the succession of operating steps of the needle position is repeated. The stitch suspended in the needle head is knocked over at the end of the following system group.

What is claimed is:

1. A piling sinker for a circular knitting machine, said sinker being configured for reciprocating movement in said knitting machine, said piling sinker further comprising an upper side adapted for engaging a yarn, said upper side of said sinker having at least two planes of differing height, said planes being configured for engaging and manipulating a pile loop yarn into loops of at least two different heights.

2. A holding-down and knock-over sinker for circular knitting machine, said sinker being configured for tensioning a pile loop yarn in the construction of a knitted fabric, said sinker being further comprising an upper knock over edge, said upper knock over edge adapted for engaging a yarn, said sinker having a bipartite nose portion upon said knock over edge, said bipartite nose portion having at least-two planes adapted for tensioning pile loop yarns into at least two distinct pile heights.

3. A circular knitting machine for the production of a plush knitted fabric having a pile with loop yarns of at least two distinct heights, said machine comprising:

a. needles for forming loops and pile loops, said needles being configured for reciprocation under the control of a lifting cam along a needle cam, b. a holding-down and knock-over sinker and a piling sinker, said respective sinkers being disposed in parallel to each other, said sinkers being configured for reciprocating movement with respect to said needles, said movement being under the control of said sinker cam, said sinker cam applying said control by employing a respective sinker curve to assist in coordinating movement of said sinkers, c. control elements for applying and selecting said needles in correspondence with a pre-determined pattern, said control elements being comprised in part of at least one lifting cam, said cam being configured for controlling the movement of a given selected needle at its location, d. a yarn feeding means for supplying a base yarn as well as at least two pile loop yarns, said yarn feeding means further comprising a piling sinker, said piling sinker being configured for reciprocating movement within said knitting machine, said piling sinker further comprising an upper side adapted for engaging a yarn, said upper side of said sinker having at least two planes of differing height, said planes being configured for engaging a pile loop yarn into loops of at least two different heights.

4. A circular knitting machine according to claim 3, further comprising a holding-down and knock-over sinker, said holding-down and knock-over sinker being configured for tensioning a pile loop yarn in the construction of a knitted fabric, said sinker further comprising an upper knock-over-edge, said upper knock-over-edge adapted for coilering a yarn, said sinker having a bipartite nose portion upon said knock over edge, said bipartite nose portion having at least two planes adapted for tensioning a pile loop yarn into at least two distinct pile heights.

* * * * *